US011822292B2

(12) United States Patent
Satou

(10) Patent No.: US 11,822,292 B2
(45) Date of Patent: Nov. 21, 2023

(54) EXTERNAL FITTING DEVICE AND WRISTWATCH

(71) Applicant: CASIO COMPUTER CO., LTD., Tokyo (JP)

(72) Inventor: Takayuki Satou, Uenohara (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 53 days.

(21) Appl. No.: 17/554,681

(22) Filed: Dec. 17, 2021

(65) Prior Publication Data

US 2022/0197222 A1 Jun. 23, 2022

(30) Foreign Application Priority Data

Dec. 18, 2020 (JP) ..... 2020-209781

(51) Int. Cl.
*G04B 37/00* (2006.01)

(52) U.S. Cl.
CPC ..... *G04B 37/005* (2013.01)

(58) Field of Classification Search
CPC ..... G04B 37/005; G04B 45/00; G04B 37/18; G04B 37/225; G04G 17/02; G04G 17/083
See application file for complete search history.

(56) References Cited

U.S. PATENT DOCUMENTS 4,835,750 A * 5/1989 Quincey ..... G04B 37/005 368/286
8,579,500 B2 * 11/2013 Penula ..... G04B 37/0008 368/283
11,442,412 B2 * 9/2022 Yasuda ..... G04G 17/02

FOREIGN PATENT DOCUMENTS

| | | | |
|---|---|---|---|
| JP | S5049466 | U | 5/1975 |
| JP | H0374392 | U | 7/1991 |
| JP | H09-243760 | A | 9/1997 |
| JP | H10-282261 | A | 10/1998 |
| JP | 2001-116859 | A | 4/2001 |
| JP | 2002-228772 | A | 8/2002 |
| JP | 2015-121514 | A | 7/2015 |

OTHER PUBLICATIONS

Notice of Reasons for Refusal dated Jan. 12, 2023 received in Japanese patent Application No. JP 2020-209781.

* cited by examiner

*Primary Examiner* — Edwin A. Leon
(74) *Attorney, Agent, or Firm* — SCULLY, SCOTT, MURPHY & PRESSER, P.C.

(57) ABSTRACT

An external fitting device includes an external fitting member having a front wall member configured to cover partially a front side of a case of a wristwatch, a side wall member continuously connected to the front wall member and configured to cover a lateral surface of the case, and a locking target member provided on the side wall member, and a fixing member comprising a locking member being locked on the locking target member, and configured to fix the external fitting member to the case by the locking member.

17 Claims, 8 Drawing Sheets

EXTERNAL FITTING DEVICE AND WRISTWATCH

CROSS-REFERENCE TO RELATED APPLICATION

This patent application is based upon the benefit of priority under 35 USC 119 from Japanese Patent Application No. 2020-209781 filed on Dec. 18, 2020, the entire disclosure of which, including the specification, claims, drawings and abstract, is incorporated herein by reference.

BACKGROUND OF THE INVENTION

Field of the Invention

The present invention relates to an external fitting device for a wristwatch and a wristwatch fitted with the external fitting device.

Description of the Related Art

There have conventionally been disclosed wristwatches fitted with an external fitting device enabling an external fitting member such as a bezel or the like to be changed. Japanese Patent Laid-Open No. 2001-116859 (JP-A-2001-116859) discloses a wristwatch enabling an external fitting member provided on a wristwatch case to be detachably attached to the wristwatch case by holding the external fitting member and the wristwatch case together with an external fitting device including a protection member which can be disposed on an upper side of a watch glass.

SUMMARY OF THE INVENTION

According to an aspect of the present invention, there is provided an external fitting device including an external fitting member having a front wall portion configured to cover partially a front side of a case of a wristwatch, a side wall portion continuously connected to the front wall portion and configured to cover a lateral surface of the case in a left-and-right direction, and a locking target portion provided on the side wall portion, and a fixing member comprising a locking portion being locked on the locking target portion, and configured to fix the external fitting member to the case by the locking portion.

DESCRIPTION OF THE PREFERRED EMBODIMENTS

First Embodiment

Figure 1:
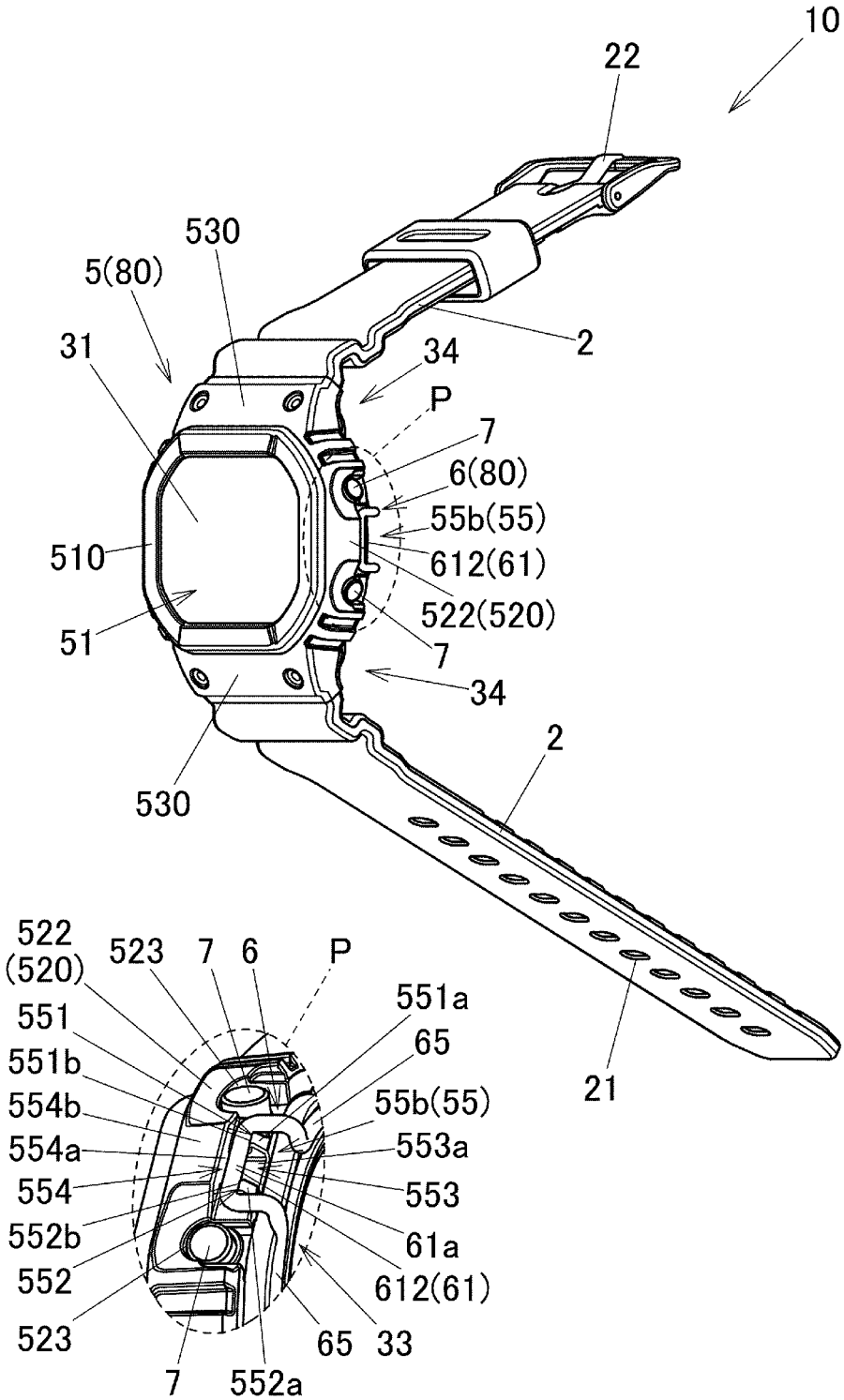
FIG. 1 shows a perspective view of a wristwatch according to a first embodiment of the present invention as viewed from a viewing side of the wristwatch and an enlarged view of a portion P, which is an enlarged perspective view of the portion P as viewed from a rear side of the wristwatch.

Hereinafter, a first embodiment of the present invention will be described based on drawings. A wristwatch 10 shown in FIG. 1 has a case 3 including a display portion 31 disposed on a viewing side (a front side) and made of a metal or a hard resin, an external fitting member 5 provided on a front side of the case 3 and made of a metal or a hard resin, watchbands 2 attached to the case 3, and a fixing member 6 provided on a rear side of the case 3 so as to fix the external fitting member 5 to the case 3. An external fitting device 80 includes the external fitting member 5 and the fixing member 6. The display portion 31 of the wristwatch 10 can display pieces of information such as time, date, the name of a day, and the like. A watch glass is provided on the display portion 31. Various systems such as an analog system, a digital system, and the like can be adopted for displaying time on the display portion 31. In the first embodiment, the digital system is adopted. Other materials including a soft resin such as a urethane resin can also be used for the external fitting member 5. In the following description, when positions are referred to with respect to the wristwatch 10, the positions are those resulting when the wristwatch 10 is viewed from a viewing side thereof while the wristwatch 10 is worn on the wrist of a user, and hence, an upper side of the wristwatch 10 (that is, an upper side in FIG. 1) is referred to as top, a lower side is referred to as bottom, a left side is referred to as left, and a right side is referred to as right. In addition, the viewing side is also referred to as a front side, and a side opposite thereto (a wrist side) is referred to as a rear side or a back side.

The watchbands 2 of the wristwatch 10 are connected together by fitting a locking pin 22 provided on a second watchband 2 in one hole portion 21 of a plurality of hole portions 21 formed in a first watchband 2. Of the watchbands 2, the first watchband 2 is attached to a lower side of the case 3, while the second watchband 2 is attached to an upper side of the case 3.

Figure 2:
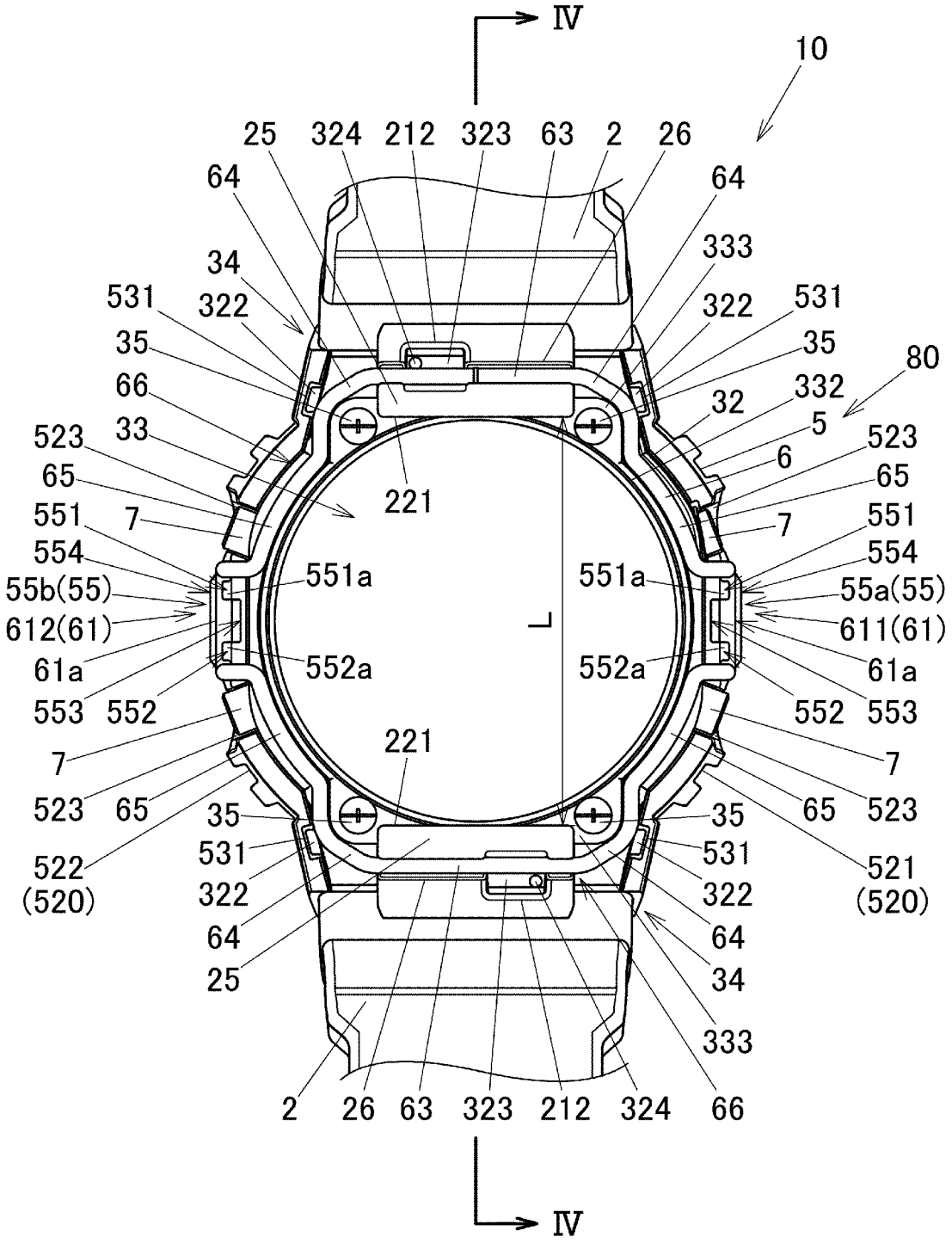
FIG. 2 is a rear view of the wristwatch according to the first embodiment of the present invention showing the rear side thereof.
Figure 4:
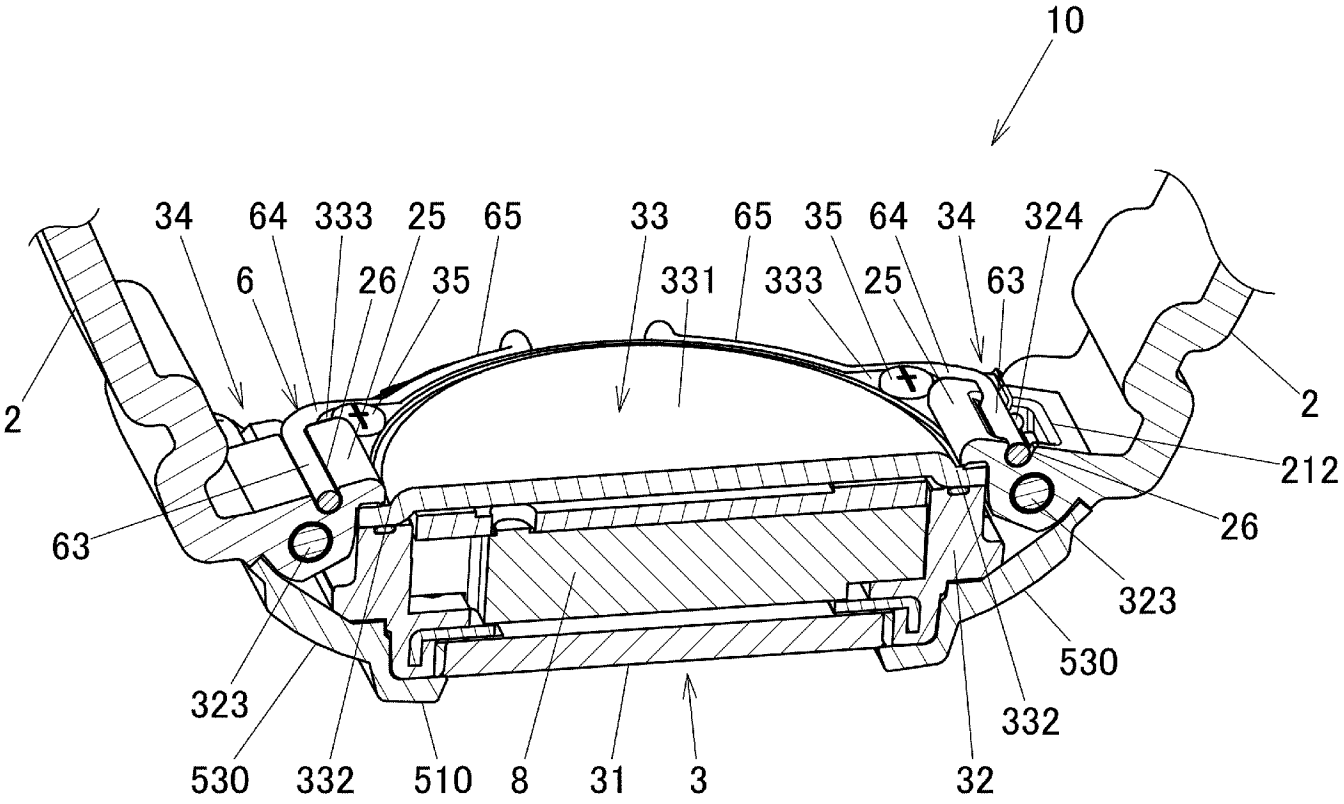
FIG. 4 is a sectional view of the wristwatch according to the first embodiment of the present invention taken along a line IV-IV shown in FIG. 2.

The case 3 is formed substantially into an octagonal prism-like bottomed cylindrical shape which is slightly longer in a left-and-right direction (a direction at right angles to the watchbands 2) as viewed from the viewing side. As shown in FIG. 4, a watch module 8 is provided in an interior of the case 3. The watch module 8 includes various types of components necessary for watch functions such as a circuit portion that is electrically driven to display a piece of information such as time or the like on the display portion 31. The case 3 includes a cylindrical case main body 32 and a substantially plate-shaped rear lid 33 positioned at a bottom portion of the case 3. The rear lid 33 has a protruding portion 331 protruding into a circular shape in the direction of a back side of the wristwatch 10, which is opposite to the viewing side thereof, and a flange portion 332 formed around an external circumference of the protruding portion 331. As shown in FIG. 2, the rear lid 33 has rectangular plate-shaped portions 333 which extend from the flange portion 332 towards the corresponding watchbands 2. Hole portions (not shown), which are designed to put bolts 35 therethrough to connect the rear lid 33 to the case main body 32, are provided near corner portions of each rectangular plate-shaped plate portion 333.

Two push buttons 7 are provided on each of left and right lateral surfaces of the case 3 as operation members, and thus, in total, four push buttons are provided on the case 3. Various settings and operations of watch functions, a stop-watch and the like can be executed with these push buttons 7. A crown can also be used as an operation member in place of the push buttons 7 depending upon the display system of the wristwatch 10.

Figure 3:
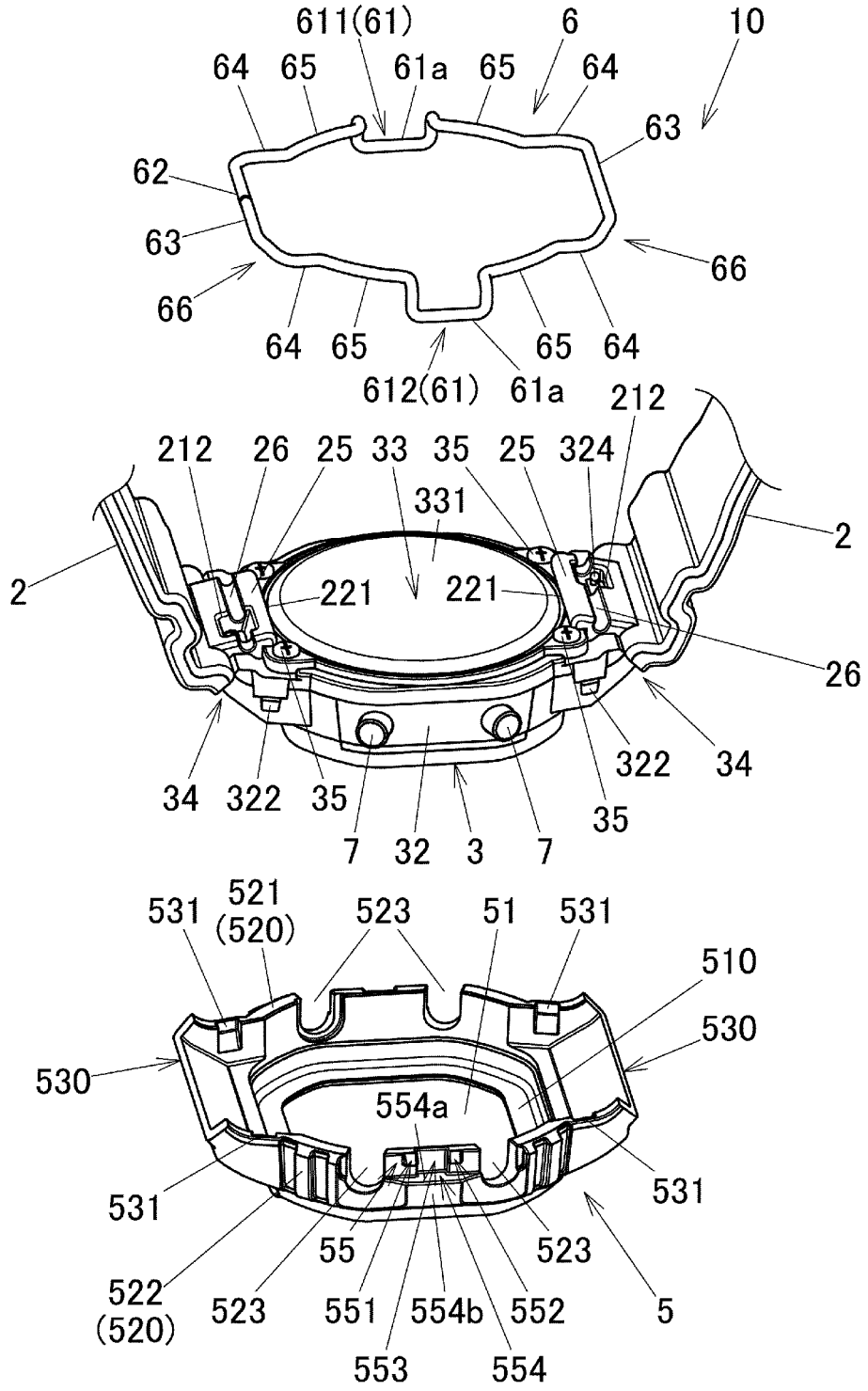
FIG. 3 is an exploded perspective view of the wristwatch according to the first embodiment of the present invention.

As shown in FIG. 3, a watchband attaching portion 34 is provided at each of the upper side and the lower side of the case 3. The watchband attaching portion 34 is formed substantially into a bifurcate shape and projects from the case main body 32 towards the watchband 2. As shown in FIG. 4, the watchband attaching portion 34 includes a spring bar 323 which is detachably passed through the watchband 2. The watchband 2 is provided so as to be detachably attached to the watchband attaching portion 34 with the spring bar 323. A known spring bar 323 including a slide lever 324 can be used for the spring bar 323.

A rotation preventing portion 25 is provided integrally at an end portion of the watchband 2, which is attached to the watchband attaching portion 34. The rotation preventing portion 25 is brought into contact with an upper surface of the rectangular plate-shaped portion 333 of the rear lid 33, which faces the watchband attaching portion 34, to thereby prevent the watchband 2 from rotating about an imaginary axis extending in a width direction of the watchband 2 towards the rear lid 33. As a result, a gap, which would be generated between the watchband 2 and the case 3 on the front side as a result of the watchband 2 falling towards the rear lid 33, is prevented from being so generated.

Then, an end portion 221 of the rotation preventing portion 25 is formed into a straight-line shape in the width direction (the left-and-right direction) of the watchband 2. The end portion 221 is tangentially in contact with an edge of the circular protruding portion 331. A recessed portion 26, in which a fixing member 6, which will be described later, fits, is provided in each watchband 2 at an external side of the rotation preventing portion 25 (specifically, with an upper rotation preventing portion 25, at an upper side of the rotation preventing portion 25, while with a lower rotation preventing portion 25, at a lower side of the rotation preventing portion 25). As a result, the fixing member 6 is provided at portions lying externally of the rotation preventing portions 25. In addition, a rectangular opening portion 212, from which the slide lever 324 of the spring bar 323 is exposed, is provided in an end portion of each watchband 2 which is positioned to face the slide lever 324 of the spring bar 323 in a position where the opening portion 212 overlaps the recessed portion 26 at the external side of the rotation preventing portion 25.

As shown in FIG. 3, the external fitting member 5 includes a substantially laterally elongated octagonal hole portion 51, from which the display portion 31 is exposed, formed in a center on a front side thereof. The external fitting member 5 is also formed externally into a substantially laterally elongated octagonal shape so as to match the case 3. Specifically speaking, the external fitting member 5 has a front wall portion 510 for partially covering the front side of the case 3 and a side wall portion 520 which is continuously connected to the front wall portion 510 and is configured to cover a lateral surface of the case 3 in the left-and-right direction. A covering portion 530 is formed individually at a top and a bottom of the external fitting member 5 in such a manner as to be continuously connected to the side wall portion 520 and the front wall portion 510 so as to cover the corresponding watchband attaching portion 34. In addition, the side wall portion 520 includes a first side wall portion 521 and a second side wall portion 522 which are configured to cover one side or a left side of a pair of sides of the case 3 in the left-and-right direction and the other side or a right side thereof, respectively.

The external fitting member 5 is attached to the case 3 in such a manner as to be placed on the case 3 from the front side thereof. The push buttons 7, which project from the case 3, are stopped from interfering with the external fitting member 5 by operation member arranging portions 523 which are formed by making U-shaped cut-outs in corresponding portions of the side wall portion 520 of the external fitting member 5. When the external fitting member 5 is attached to the case 3, the external fitting member 5 is guided as a result of guide portions 322, which are provided on lateral surfaces of the watchband attaching portions 34 in the left-and-right direction in such a manner as to project therefrom, being brought into engagement with corresponding recessed guiding target portions 531 provided on the covering portions 530 of the external fitting member 5. The external fitting member 5 and the case 3 can be brought into engagement with each other to such an extent that the external fitting member 5 and the case 3 are lightly fixed to each other (to such an extent that the external fitting member 5 and the case 3 are easily disengaged from each other with the fingers) by adjusting clearances therebetween by tapering the guide portions 322 and the guiding target portions 531. Alternatively, a clicking feel may be given by irregular engagement.

As shown in an enlarged view of a portion P in FIG. 1 and FIG. 2, locking target portions 55 are provided individually on external surfaces of the left and right side wall portions 520 (the first side wall portion 521, the second side wall portion 522) of the external fitting member 5. Of the locking target portions 55, a first locking target portion **55*a* is provided on the left, that is, first side wall portion 521, and a second locking target portion 55*b* is provided on the right, that is, second side wall portion 522. The locking target portion 55 is provided between the two operation member arranging portions 523, 523 (the push buttons 7, 7) on each lateral surface in the left-and-right direction. As shown in the enlarged view of the portion P in FIG. 1, two projecting portions 551, 552 are provided on the locking target portion 55, and the two projecting portions 551, 552 are aligned with each other vertically or in the up-and-down direction on each lateral surface of the external fitting member 5 in the left-and-right direction. A portion defined between the two projecting portions 551, 552 is formed into a groove portion 553. The projecting portions 551, 552 are each formed into a hook-like shape, and inclined surfaces 551***a*, 552*a* are formed on the projecting portions 551, 552, respectively. The inclined surfaces 551*a*, 552*a* are each made into an inclined surface which is inclined in a direction in which the inclined surface expands externally from the rear side towards the front side. A receiving step portion 554 is formed in a position which faces locking target surfaces 551*b*, 552*b*, which constitute viewing-side surfaces of the projecting portions 551, 552. A bottom surface 553*a* of the groove portion 553 and a receiving surface 554*a* of the receiving step portion 554 are at right angles to each other. The locking target portion 55 may be provided on an edge surface of an internal or back side of the side wall portion 520 (that is, an end portion opposite to an end portion of the side wall 520 which faces the front side wall portion 510).

As shown in FIG. 3, the fixing member 6 is formed into an annular shape by wire forming a metallic linear member such as a wire or the like and welding it at a welding portion 62. In the fixing member 6, locking portions 61, which each have a substantially rectangular shape in a side view, are provided at two locations facing each other, and a left locking portion 61 is referred to as a first locking portion 611, and a right locking portion 61 is referred to as a second locking portion 612. Each locking portion 61 projects substantially into a U-shape in a side view towards an axial direction of the annular shape. Linearly formed groove engagement portions 63 are provided individually at portions of the fixing member 6 which lie at right angles to the locking portions 61. Both ends of each linear groove engagement portion 63 connect individually to bent portions 64 and further connect to the locking portions 61 via externally projecting arc-shaped portions 65. Elastic spring-back force can be generated in the first locking portion 611 and the second locking portion 612 which are disposed to face each other. That is, when the first locking portion 611 and the second locking portion 612 are deformed in a direction in which the first locking portion 611 and the second locking portion 612 move away from each other, elastic spring-back force is generated in the first locking portion 611 and the second locking portion 612 in a direction in which the first locking portion 611 and the second locking portion 612 move towards each other. The first locking portion 611 and the second locking portion 612 are connected to each other by two connecting portions 66 each made up of one groove engagement portion 63, two bent portions 64 connecting to the both ends of the groove engagement portion 63, and the arc-shaped portions 65 connecting to the corresponding bent portions 64.

As shown in the enlarged view of the portion P in FIG. 1, in the fixing member 6, a linear portion 61*a* of the locking portion 61 is disposed between the locking target surfaces 551*b*, 552*b* of the projecting portions 551, 552 of the locking target portion 55 and the receiving surface 554*a* of the receiving step portion 554, whereby the locking portion 61 is locked on the locking target portion 55. Specifically speaking, as shown in FIG. 2, the first locking portion 611 is locked on the first locking target portion 55*a*, and the second locking portion 612 is locked on the second locking target portion 55*b*. In addition, the groove engagement portions 63 of the fixing member 6 fit in the recessed portions 26 of the rotation preventing portions 25 for engagement therewith. Then, the bent portions 64 of the fixing member 6 are disposed along external edges of the rectangular plate-shaped portions 333 of the rear lid 33. Similarly, the arc-shaped portions 65 of the fixing member 6 are disposed along an external edge of the flange portion 332 of the rear lid 33. In this way, the fixing member 6 is disposed along an external circumference of the rear lid 33. That is, the fixing member 6 is disposed in such a manner as not to overlap the rear lid 33 in a plan view (as viewed from the rear side). In other words, the connecting portions 66, which constitute portions of the fixing member 6 other than the locking portions 61, are provided on a rear surface of the case main body 32 along an external circumferential portion of the rear lid 33.

The arc-shaped portions 65 and the bent portions 64 of the fixing member 6 are partially disposed on a rear side of the case main body 32. Then, a height from an edge surface on the rear side of the case main body 32 to the fixing member 6 disposed on the edge surface is lower than a height from the edge surface to an external surface of the protruding portion 331 of the rear lid 33. In other words, as shown in FIG. 2, within a range L defined inside between the end portions 221 of the facing rotation preventing portions 25 (that is, the range L defined inside between tangents to an upper side and a lower side of the rear lid 33), the portions other than the locking portions 61 of the fixing member 6 (the whole of the fixing member 6 including the locking portions 61 of the fixing member 6 in the present embodiment) are disposed further forwards towards the front side than the external surface of the rear lid 33. A range of the wristwatch 10 which is brought into abutment with the wrist when the wristwatch 10 is worn the wrist is defined by the range L in the up-and-down direction and the width of the case 3 in the left-and-right direction. There may be a case in which the fixing member 6 is not brought into abutment with the edge surface on the rear side of the case main body 32.

Figure 5A:
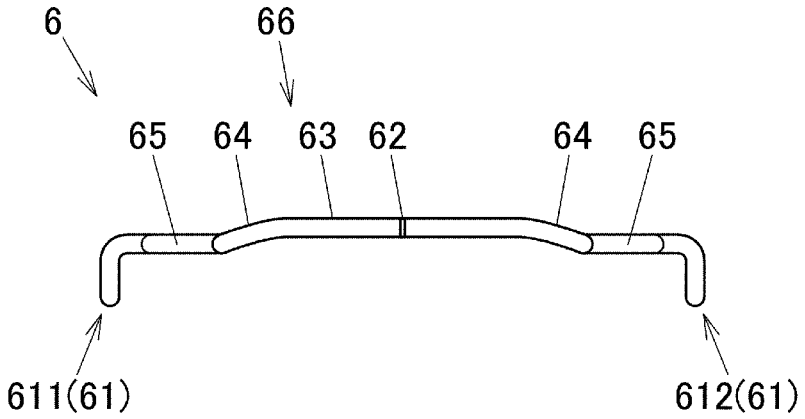
FIG. 5A is a vertical side view of a fixing member showing a deformed state of the fixing member when the fixing member is attached to the wristwatch according to the first embodiment of the present invention, the deformed state showing a state resulting before the fixing member is attached.
Figure 5B:
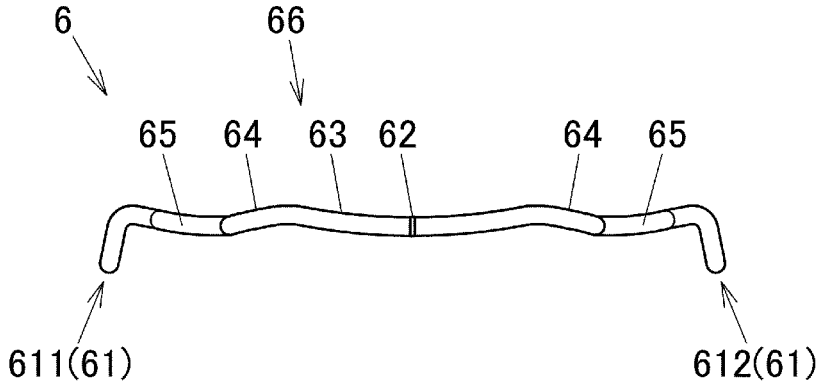
FIG. 5B is a vertical side view of the fixing member showing a deformed state of the fixing member when the fixing member is attached to the wristwatch according to the first embodiment of the present invention, the deformed state showing a state resulting after the fixing member is attached.

To attach the fixing member 6, the fixing member 6 is pushed on to the case 3 on which the external fitting member 5 is mounted from the rear side thereof with the locking portions 61 aligned in position with the locking target portions 55. Then, the linear portions 61*a* of the locking portions 61 slide on the inclined surfaces 551*a*, 552*a* of the projecting portions 551, 552 of the locking target portions 55, and the first locking portion 611 and the second locking portion 612 expand in such a manner as to move away from each other in the left-and-right direction, whereby the linear portions 61*a* of the locking portions 61 are disposed between the locking target surfaces 551*b*, 552*b* of the projecting portion 551, 552 and the receiving surfaces 554*a* of the receiving step portions 554. At this time, the first locking portion 611 and the second locking portion 612 expand in the direction in which the first locking portion 611 and the second locking portion 612 move away from each other, whereby the fixing member 6 is disposed in such a manner as to be locked on the first locking target portion 55*a* and the second locking target portion 55*b*. That is, the fixing member 6 is formed such that a space defined between the first locking portion 611 and the second locking portion 612 is narrower than a space defined between the first locking target portion 55*a* and the second locking target portion 55*b* (a space defined between the left and right locking target surfaces 551*b*, 552*b*). As a result, when the fixing member 6 is mounted on the external fitting member 5, the fixing member 6 is mounted on the external fitting member 5 in such a state that the fixing member 6 is deformed into a convexly curved shape protruding towards the external fitting member 5 as a whole as shown in FIG. 5B from a state of the fixing member 6 shown in FIG. 5A. Consequently, the portions of the fixing member 6 which are convexly curved (specifically, the arc-shaped portions 65) press against the back side of the case 3 (the edge surfaces on the back side of the case main body 43) with the locking portions 61 of the fixing member 6 locked on the locking target portions 55, whereby the elastic spring-back force of the fixing member 6 is caused to act on the external fitting member 5 in a thickness direction of the case 3. As a result, the external fitting member 5 is pressed strongly against the case 3 in a backward direction. Since the external fitting member 5 is fixed to the case 3 in the way described above, the external fitting member 5 is fixed to the case 3 not only in the thickness direction of the case 3 but also in the up-and-down direction and the left-and-right direction of the case 3. FIG. 5B shows the curved state in an exaggerated fashion for the purpose of understanding. In addition, the linear portion 61*a* of the fixing portion 61 is positioned further inwards than a lateral surface 554*b* of the receiving step portion 554. As a result, there is no risk of the fixing member 6 being disengaged as a result of the linear portion 61*a* of the fixing portion 61 being caught on the projecting portions 551, 552.

Figure 6A:
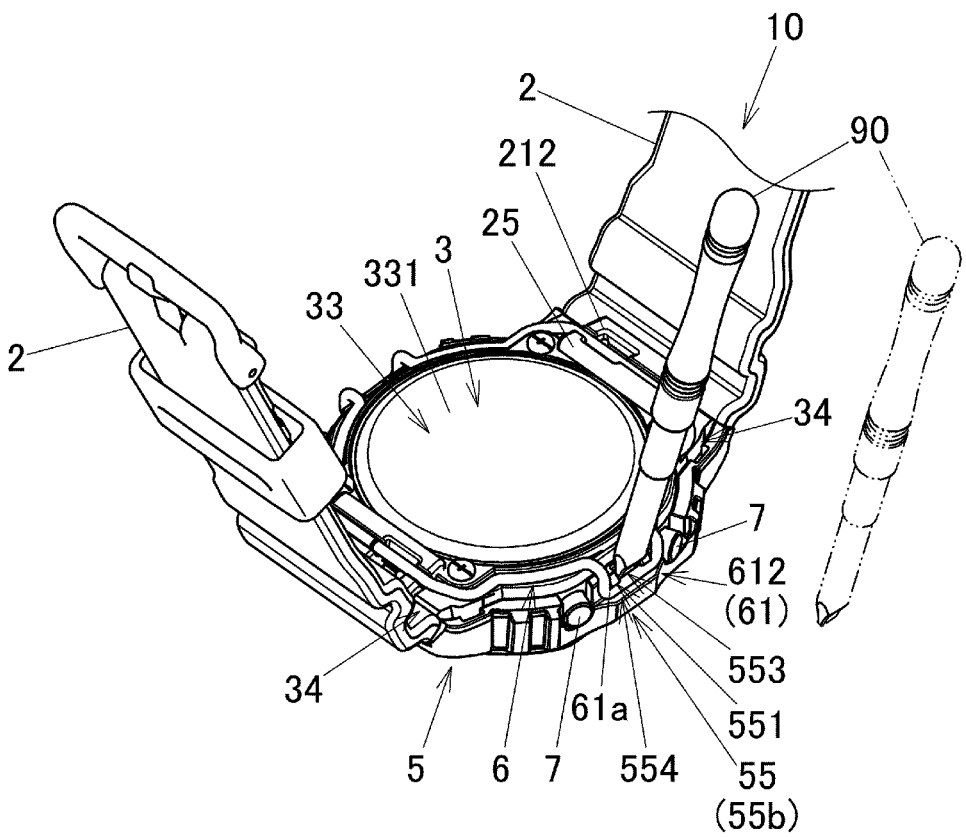
FIG. 6A is a perspective view showing a state in which the fixing member of the wristwatch according to the first embodiment of the present invention is removed with a jig, the state showing that the jig is inserted in a groove portion.
Figure 6B:
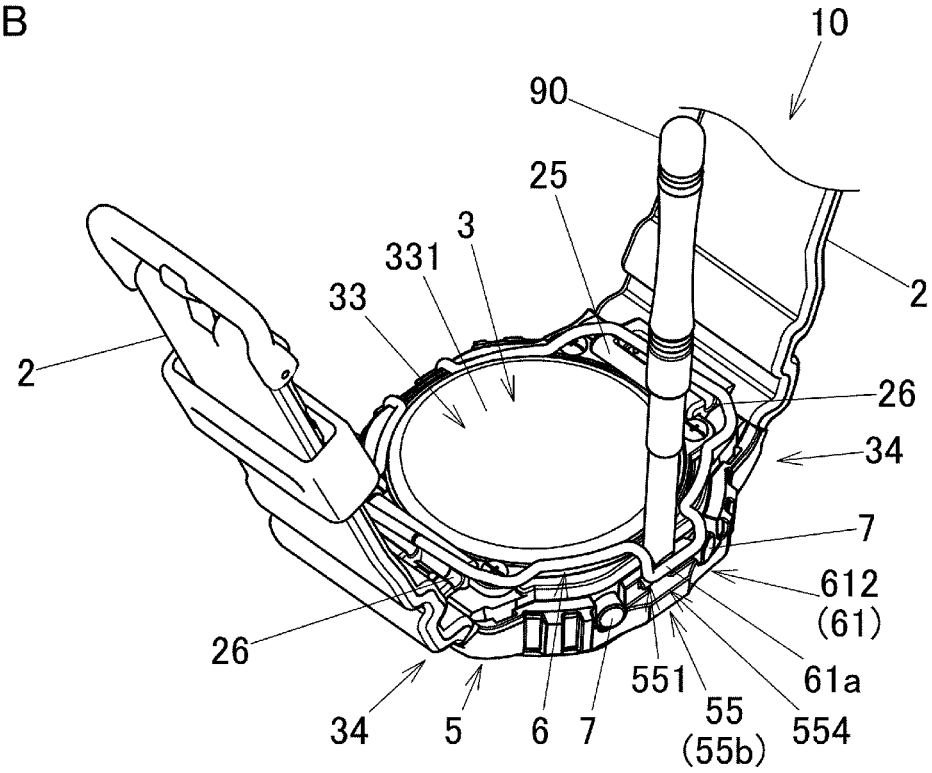
FIG. 6B is a perspective view showing a state in which the fixing member of the wristwatch according to the first embodiment of the present invention is removed with the jig, the state showing that the fixing member is removed with the jig.

To remove the fixing member 6, as shown in FIG. 6A, a distal end portion, whose tip is formed like a keystone tip of a screwdriver, of a jig 90 is inserted into the groove portion 553 of the locking target portion 55, and the distal end portion of the jig 90 is applied to the linear portion 61*a* of the locking portion 61. Then, as shown in FIG. 6B, the linear portion 61*a* of the locking portion 61 is forcibly expanded outwards with the jig 90, whereby the locking portion 61 is disengaged from the projecting portions 551, 552, allowing the fixing member 6 to be removed from the case 3. Then, the external fitting member 5 is removed from the case 3, and another replacement external fitting member 5 is mounted on the case 3 and is fixed in place by the fixing member 6, completing the replacement of the external fitting members 5.

Second Embodiment

Next, a second embodiment of the present invention will be described based on FIGS. 7A, 7B. A wristwatch 10A according to the second embodiment of the present invention includes, in place of the annular fixing member 6 of the first embodiment, a fixing member 6A including a connecting portion 66A made up of a rubber belt for connecting a first locking portion 611A and a second locking portion 612A. The wristwatch 10A is configured the same as the wristwatch 10 of the first embodiment and hence includes the same constituent members such as a case 3, an external fitting member 5, watchbands 2, and the like other than the fixing member 6A. Thus, the description of the same constituent members will be omitted or simplified here.

Figure 7A:
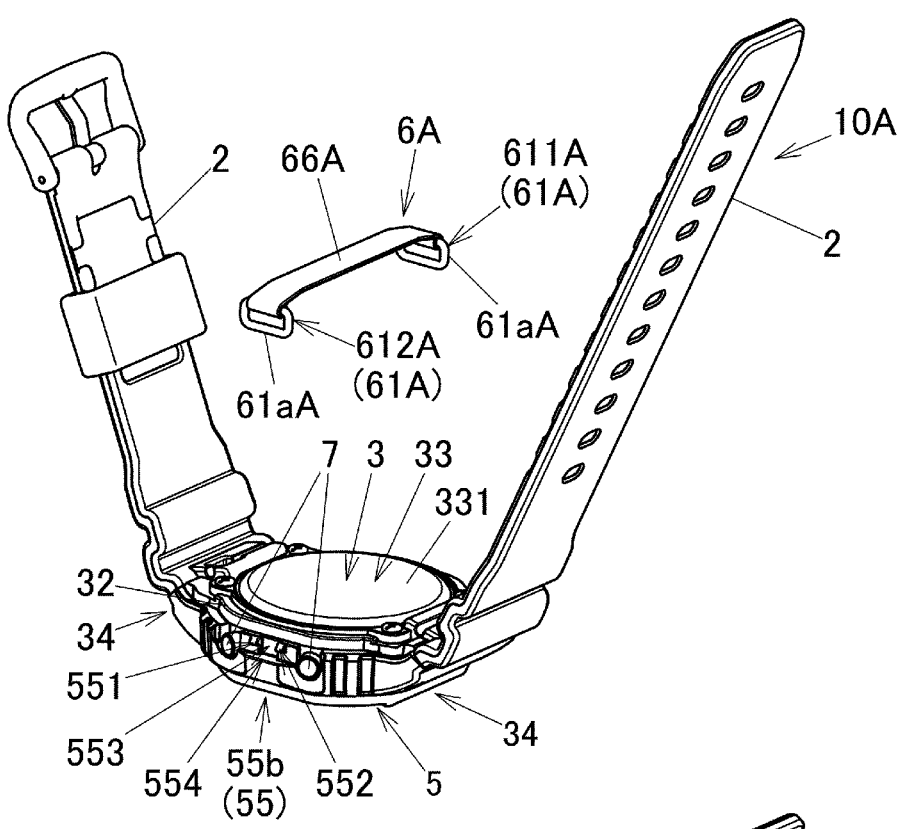
FIG. 7A is a perspective view showing a wristwatch according to a second embodiment of the present invention with a fixing member and the wristwatch separated from each other.
Figure 7B:
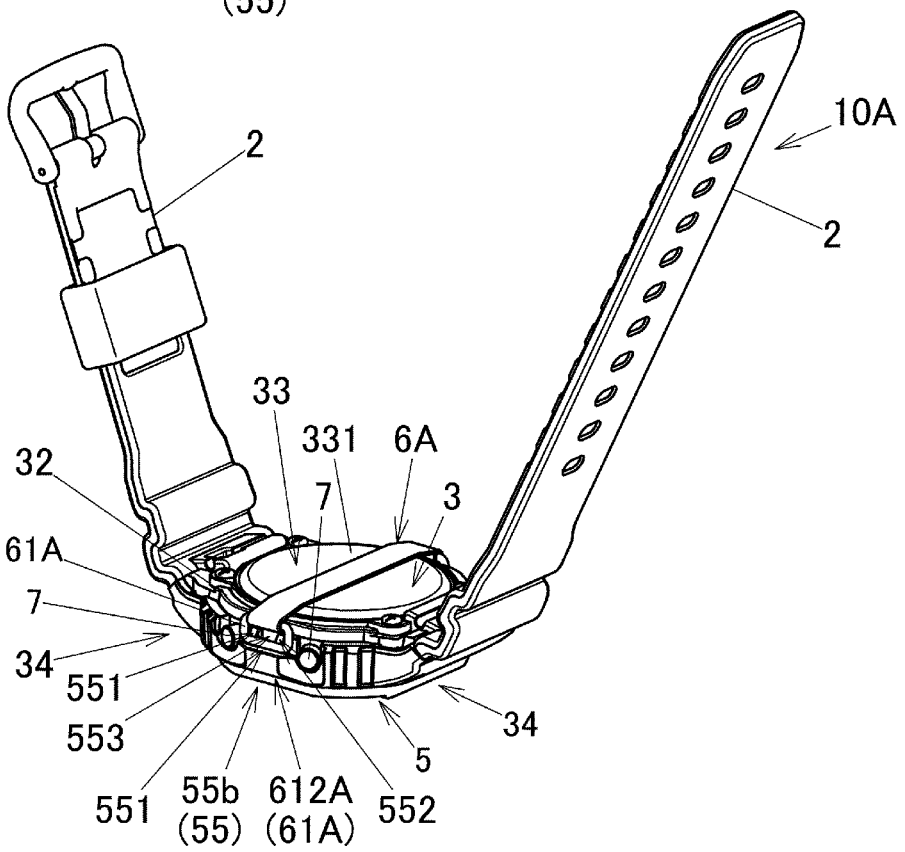
FIG. 7B is a perspective view showing the wristwatch according to the second embodiment of the present invention with the fixing member attached to the wristwatch.

As shown in FIG. 7A, the fixing member 6A has two elongated rectangular annular locking portions 61A. Then, the connecting portion 66A is provided in such a manner as to extend between the first locking portion 611A and the second locking portion 612A which are disposed at the left and right of the connecting portion 66A as the locking portions 61A. With the fixing member 6A, when the first locking portion 611A and the second locking portion 612A are moved in a direction in which the first locking portion 611A and the second locking portion 612A move away from each other, the first locking portion 611A and the second locking portion 612A are biased in a direction in which the first locking portion 611A and the second locking portion 612A move towards each other.

To attach the fixing member 6A to the case 3, the locking portions 61A are locked on corresponding locking target portions 55 from a rear side of the case 3. Specifically speaking, linear portions 61*a*A of the locking portions 61A are disposed between locking target surfaces 551*b*, 552*b* of projecting portions 551, 552 and receiving surfaces 554*a* of receiving step portions 554. At this time, since the locking portions 61A are disposed so as to expand in a direction in which the locking portions 61A move away from each other, the linear portions 61*a*A of the locking portions 61A are disposed between the locking target surfaces 551*b*, 552*b* and the receiving surfaces 554*a* in an ensured fashion. Since the locking portions 61A are locked on the locking target portions 55 in this way, an external fitting member 5 is pressed against the case 3, whereby the external fitting member 5 is restricted from moving not only in a thickness direction of the case 3 but also in an up-and-down direction and a left-and-right direction thereof. As a result, the external fitting member 5 is fixed to the case 3.

To remove the fixing member 6A, the jig 90 (refer to FIGS. 6A, 6B) can be used to remove the fixing member 6A as the fixing member 6 of the first embodiment is removed using the jig 90.

Figure 8:
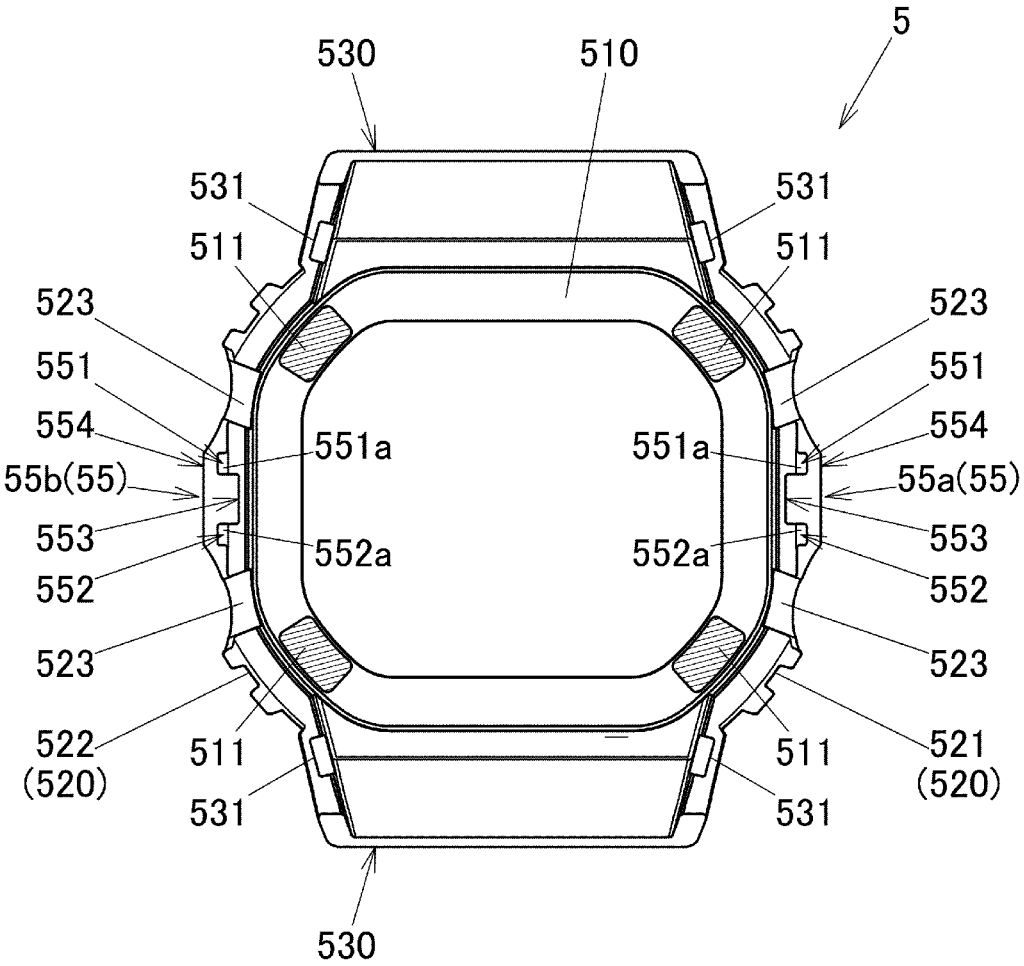
FIG. 8 is a plan view of a wristwatch according to a first modified example 1 of the present invention with an external fitting member viewed from a rear side of the wristwatch.

(First Modified Example) A first modified example made to the embodiments described heretofore will be described based on FIG. 8. In the first modified example, dampers 511, which are shown as hatched in FIG. 8, can be provided between a front wall portion 510 of an external fitting member 5 and portions on a case 3 which face the front wall portion 510. The dampers 511 are provided individually at four corners, that is, top left and right corners and bottom left and right corners of the front wall portion 510. The dampers 511 can be disposed fixedly to at least either the external fitting member 5 or the case 3. The dampers 511 can each be made up of a member exhibiting elastic force like a member made up of a urethane rubber or a foamed material of a predetermined thickness. At this time, as to the rigidity of the external fitting member 5, the external fitting member 5 is made of a material having rigidity equal to or higher than the rigidity of the case 3. By disposing the dampers 511 as described above, when the external fitting member 5 is pressed against the case 3 by the fixing member 6, 6A, the dampers 511 are compressed and further can prevent the external fitting member 5 from being loosened relative to the case 3 not only in a thickness direction of the case 3 but also in an up-and-down direction and a left-and-right direction thereof.

Thus, according to the embodiments, the wristwatch 10 including the external fitting device 80 includes the external fitting member 5 having the front wall portion 510 which covers partially the front side of the case 3 of the wristwatch 10, the side wall portions 520 which cover the lateral surfaces of the case 3 in the left-and-right direction, and the locking target portions 55 provided on the side wall portions 520, and the fixing member 6 having the locking portions 61, provided on the rear side of the case 3, and configured to fix the external fitting member 5 to the case 3 as a result of the locking portions 61 being locked on the locking target portions 55. As a result, the fixing member 6 for fixing the external fitting member 5 can be provided in such a manner as not to become visible from the viewing side (in particular, the front side further forwards than the watch glass of the display portion 31). Consequently, a risk can be reduced in which the external fitting member 5 is disengaged unexpectedly as a result of the fixing member 6 being caught by something else while the wristwatch 10 is being worn on the wrist of the user. In addition, since the fixing member 6 can be made invisible from the viewing side, the degree of freedom in designing a wristwatch can be enhanced.

The side wall portions 520 include the first side wall portion 521 and the second side wall portion 522 which cover one lateral surface of the pair of lateral surfaces of the case 3 in the left-and-right direction and the other lateral surface thereof, respectively, the locking target portions 55 include the first locking target portion 55*a* and the second locking target portion 55*b* which are provided on the first side wall portion 521 and the second side wall portion 522, respectively, and the fixing member 6 has, as the locking portions 61, the first locking portion 611 and the second locking portion 612 which are locked at the first locking target portion 55*a* and the second locking target portion 55*b*, respectively, and the connecting portions 66 which connect the first locking portion 611 and the second locking portion 612 to each other. As a result, the external fitting member 5 can be locked on the case 3 at the two left and right portions in an ensured fashion, and the first locking portion 611 and the second locking portion 612 can be formed integrally by the connecting portions 66, whereby the fixing member which is easy to be handled can be provided.

The case 3 includes the case main body 32 located on the front side and the rear lid 33, and the portions other than the locking portions 61 of the fixing member 6 are provided on the case main body 32 along the external circumferential portion of the rear lid 33. As a result, the fixing member 6 can be disposed while avoiding the interference with the rear lid 33 including the bolts 35 for connecting the rear lid 33 and the case main body 32 together, whereby only the rear lid 33 can be removed without removing the fixing member 6 even in the case that the rear lid 33 needs to be removed for maintenance such as replacement of batteries.

With the wristwatch 10 worn on the wrist of the user, the rear lid 33 is in abutment with the wrist, and within the range where the rear lid 33 is in abutment with the wrist, the portions other than the locking portions 61 of the fixing member 6 are disposed further forwards towards the front side than the external surface of the rear lid 33. As a result, the fixing member 6 provided on the case main body 32 never projects from the rear lid 33, whereby when the wristwatch 10 is worn on the wrist of the user, the rear lid 33 is left in contact with the wrist most of the time, thereby restricting the fixing member 6 from being brought into contact with the wrist.

The watchbands 2 having the rotation preventing portion 25 are provided on the case 3, whereby the watchbands 2 are prevented from rotating about the corresponding imaginary axes extending in the width direction of the watchbands 2 towards the rear lid 33, and the recessed portions 26 are formed individually in the rotation preventing portions 25, allowing the fixing member 6 to fit in the recessed portions 26 in the rotation preventing members 25 in an engaged fashion. As a result, the watchbands 2 can be restricted from rotating by the rotation preventing portions 25 in an ensured fashion without being interrupted by the fixing member 6.

The case main body 32 has the guide portions 322 which guide the external fitting member 5 by being brought into engagement with the guiding target portions 531 on the external fitting member 5. As a result, the external fitting member 5 can easily be attached to the case main body 32 of the case 3.

The locking target portion 55 includes the plurality of projecting portions 551, 552 which are aligned with each other in the up-and-down direction of the side wall portion 520, and the locking portion 61 is locked on the plurality of projecting portions 551, 552. Then, the groove 553 is provided between the plurality of projecting portions 551, 552 for guiding the jig 90 for releasing the locking of the locking portion 61 on the plurality of projecting portions 551, 552. As a result, the fixing member 6 can easily be removed with the jig 90.

The plurality of push buttons 7, 7 are provided on the lateral surface of the case 3 in the left-and-right direction in such a manner as to be aligned in the up-and-down direction of the lateral surfaces of the case 3 in the left-and-right direction, and the locking target portion 55 is disposed between the push buttons 7, 7, which constitute the plurality of operation members. As a result, the locking target portion 55 and the locking portion 61 can be disposed neatly even on the lateral surface of the wristwatch 10 which becomes visible from time to time. In addition, the locking target portion 55 and the locking portion 61, which are so disposed, never interrupt the operation of the push buttons 7.

The external fitting member 5 has the operation member arranging portions 523 which are cut out into the U-shape so as not to interfere with the push buttons 7, 7. As a result, the external fitting member 5 can also be mounted even on the case 3 including the push buttons 7.

The guide portions 322 are provided on the case 3, and the external fitting member 5 has the guiding target portions 531 which are brought into engagement with the corresponding guide portions 322, whereby the external fitting member 5 is guided as a result of the guiding target portions 531 being brought into engagement with the corresponding guide portions 322. As a result, the external fitting member 5 can be mounted and dismounted smoothly.

The external fitting member 5 is made of the material having the rigidity equal to or higher than the rigidity of the case 3, and the dampers 511 are disposed between the front wall portion 510 and the case 3. The dampers 511 are provided on at least either the external fitting member 5 or the case 3. As a result, the external fitting member 5 is restricted further from getting loosened relative to the case 3.

The fixing member 6 is formed into the annular shape using the linear members. As a result, the fixing member 6 can be made difficult to be visible from the outside. However, the fixing member 6 is not limited to the linear members, and hence, the fixing member 6 can be made up of a combination of a prism and a circular cylinder or can be formed into a block-like shape.

While the embodiments of the present invention have been described heretofore, the embodiments are presented as examples, and hence, there is no intention to limit the scope of the present invention by the embodiments. The novel embodiments can be carried out in other various forms, and various omissions, replacements and modifications can be made thereto without departing from the spirit and scope of the present invention. Those resulting embodiments and their modifications are included in the scope and gist of the present invention and are also included in the scope of inventions claimed for patent under claims below and their equivalents.

What is claimed is:

1. An external fitting device comprising:

an external fitting member comprising a front wall member configured to cover partially a front side of a case of a wristwatch, a side wall member continuously connected to the front wall member and configured to cover a lateral surface of the case, and a locking target member provided on the side wall member, wherein the case comprises a case main body on the front side and a rear lid on the rear side thereof; and a fixing member comprising a locking member being locked on the locking target member, wherein members other than the locking member of the fixing member are provided on the case main body along an external circumferential area of the rear lid; and the fixing member is configured to fix the external fitting member to the case by the locking member.

2. The external fitting device according to claim 1, wherein the front wall member covers an external side of a display area provided on the front side of the case of the wristwatch.

3. The external fitting device according to claim 1, wherein the side wall member of the external fitting member covers a lateral surface of the case in a left-and-right direction.

4. The external fitting device according to claim 1, wherein the locking member of the fixing member is provided on a rear side of the case.

5. The external fitting device according to claim 1, wherein the side wall member comprises a first side wall member and a second side wall member which are configured to cover one lateral surface of a pair of lateral surfaces of the case in the left-and-right direction and an other lateral surface thereof, respectively, wherein the locking target member comprises a first locking target member and a second locking target member which are provided on the first side wall member and the second side wall member, respectively, and wherein the fixing member comprises, as the locking member, a first locking member and a second locking member which are configured to be locked on the first locking target member and the second locking target member, respectively, and a connecting member configured to connect the first locking member and the second locking member to each other.

6. The external fitting device according to claim 1, wherein the rear lid is in abutment with a wrist in such a state that the external fitting device is mounted on the wrist, and wherein in a range where the rear lid is in abutment with the wrist, the members other than the locking member of the fixing member are disposed further forwards towards the front side than an external surface of the rear lid.

7. The external fitting device according to claim 1, wherein a watchband comprising a rotation preventing member is provided on the case, wherein the watchband is prevented from rotating about an imaginary axis extending in a width direction of the watchband towards the rear lid by a contact of the rotation preventing member with an area on a back side of the case, wherein a recessed area is formed in the rotation preventing member, and wherein the fixing member is in engagement with the recessed area in the rotation preventing member.

8. The external fitting device according to claim 1, wherein the locking target member comprises a plurality of projecting members which are aligned with each other in an up-and-down direction of the side wall member, wherein the locking member is locked on the plurality of projecting members, and wherein a groove area is provided between the plurality of projecting members, the groove area being configured to guide a jig for releasing the locking of the locking member on the plurality of projecting members.

9. The external fitting device according to claim 1, wherein a plurality of operation members are provided on the lateral surface of the case in the left-and-right direction in such a manner as to be aligned in the up-and-down direction of the lateral surface of the case in the left-and-right direction, and wherein the locking target member is disposed between the plurality of operation members.

10. The external fitting device according to claim 9, wherein the external fitting member comprises operation member arranging areas which are cut out into a U-shape so as not to interfere with the operation members.

11. The external fitting device according to claim 1, wherein a guide member is provided on the case, wherein the external fitting member comprises a guiding target member configured to be brought into engagement with the guide member, and wherein the external fitting member is guided by the guiding target member being brought into engagement with the guide member.

12. The external fitting device according to claim 1, wherein the external fitting member is made of a material having a rigidity which is equal to or higher than a rigidity of the case, and wherein a damper is disposed between the front wall member and the case, the damper being provided on at least either the external fitting member or the case.

13. The external fitting device according to claim 1, wherein the fixing member is formed of a linear member into an annular shape.

14. A wristwatch comprising the external fitting device according to claim 1.

15. An external fitting device comprising:

an external fitting member comprising a front wall member configured to cover partially a front side of a case of a wristwatch, a side wall member continuously connected to the front wall member and configured to cover a lateral surface of the case, and a locking target member provided on the side wall member, wherein the locking target member comprises a plurality of projecting members which are aligned with each other in an up-and-down direction of the side wall member and a groove area is provided between the plurality of projecting members; and a fixing member comprising a locking member being locked on the plurality of projecting members of the locking target member to fix the external fitting member to the case by the locking member, wherein the groove area is configured to guide a release of the locking member on the plurality of projecting members.

16. The external fitting device according to claim 15, wherein the groove area is configured to guide a jig for releasing the locking of the locking member on the plurality of projecting members.

17. An external fitting device comprising:

an external fitting member comprising a front wall member configured to cover partially a front side of a case of a wristwatch, a side wall member continuously connected to the front wall member and configured to cover a lateral surface of the case, and a locking target member provided on the side wall member, wherein the case comprises a case main body on the front side and a rear lid on the rear side thereof; and a fixing member comprising a locking member being locked on the locking target member, wherein members other than the locking member of the fixing member are provided on the case main body along an external circumferential area of the rear lid, and wherein the fixing member is formed of a linear member into an annular shape; and the fixing member is configured to fix the external fitting member to the case by the locking member.

* * * * *